US009708115B2

(12) United States Patent
Hirata et al.

(10) Patent No.: US 9,708,115 B2
(45) Date of Patent: Jul. 18, 2017

(54) SCENTED PAPER TISSUE CONTAINER

(71) Applicant: DAIO PAPER CORPORATION, Ehime (JP)

(72) Inventors: Norimitsu Hirata, Shizuoka (JP); Hisayuki Sakurai, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 0 days.

(21) Appl. No.: 15/024,487

(22) PCT Filed: Feb. 17, 2015

(86) PCT No.: PCT/JP2015/054243

§ 371 (c)(1),
(2) Date: Mar. 24, 2016

(87) PCT Pub. No.: WO2015/133261

PCT Pub. Date: Sep. 11, 2015

(65) Prior Publication Data

US 2016/0244241 A1 Aug. 25, 2016

(30) Foreign Application Priority Data

Mar. 5, 2014 (JP) ..... 2014-042361

(51) Int. Cl.
*B65D 83/08* (2006.01)
*A47K 10/32* (2006.01)

(52) U.S. Cl.
CPC ..... *B65D 83/0835* (2013.01); *A47K 10/32* (2013.01); *A47K 2010/322* (2013.01); *B65D 2203/12* (2013.01)

(58) Field of Classification Search
CPC ..... A47K 7/00; A47K 10/20; A47K 10/32; A47K 10/42; A47K 10/421;
(Continued)

(56) References Cited

U.S. PATENT DOCUMENTS 7,004,313 B2 * 2/2006 Mitchell ..... B65D 83/0805 206/494
7,022,945 B1 * 4/2006 Western ..... A47K 10/42 126/263.01
(Continued)

FOREIGN PATENT DOCUMENTS

CN 101208248 A 8/2008
JP 03-066883 U1 6/1991
(Continued)

OTHER PUBLICATIONS

Japanese Office Action dated May 22, 2015 in corresponding Japanese Application No. 2014-042361; 7 pgs.
(Continued)

*Primary Examiner* — Bryon Gehman
(74) *Attorney, Agent, or Firm* — Maier & Maier, PLLC

(57) ABSTRACT

A scented sheet member, in which a gelatin gel including at least one of a perfume and a perfume-containing microcapsule is enclosed in a space between film sheets in at least one of which a perfume-permeating hole is formed, is affixed to an inner surface of an upper surface of the containing box so that the at least one of the film sheets having the perfume-permeating hole faces a stack of paper tissues. This can provide a scented paper tissue container that can strengthen a scent when necessary.

4 Claims, 4 Drawing Sheets

(58) Field of Classification Search
CPC ..... A47K 2010/322; A47K 2010/3226; A47K 2010/428; B65D 71/34; B65D 75/52; B65D 75/58; B65D 83/08; B65D 83/0805; B65D 85/00; B65D 85/62; B65D 2203/12
USPC ..... 206/233, 494, 812; 221/33, 45–50
See application file for complete search history.

(56) References Cited

U.S. PATENT DOCUMENTS

| | | | | |
|---|---|---|---|---|
| 7,571,832 | B2 * | 8/2009 | Mark | B65D 83/0894 221/33 |
| 7,681,725 | B2 * | 3/2010 | Mueller | B65D 75/5833 206/233 |
| 2004/0124101 | A1 | 7/2004 | Mitchell et al. | |
| 2009/0127149 | A1 * | 5/2009 | Samarcq | B65D 5/4204 206/494 |
| 2010/0243668 | A1 * | 9/2010 | Castela | B65D 83/0805 221/45 |
| 2011/0042257 | A1 * | 2/2011 | Mueller | B65D 77/24 206/494 |

FOREIGN PATENT DOCUMENTS

| | | | | |
|---|---|---|---|---|
| JP | 07-097474 | A | 4/1995 | |
| JP | H08-000294 | Y2 | 1/1996 | |
| JP | 2005-21548 | A | 1/2005 | |
| JP | WO 2007004562 | A1 * | 1/2007 | B65D 83/0805 |
| JP | 2007-050905 | A | 3/2007 | |
| JP | 5225591 | B2 | 9/2008 | |
| JP | 2009-256231 | A | 11/2009 | |
| JP | 2010-052815 | A | 3/2010 | |
| JP | 2012-196382 | A | 10/2012 | |
| WO | 2007-004562 | A1 | 1/2007 | |

OTHER PUBLICATIONS

Japanese Decision to Grant dated Aug. 21, 2015 in corresponding Japanese Application No. 2014-042361; 5 pgs.
International Search Report of corresponding PCT/JP2015/054243 dated May 26, 2015.
Chinese Office Action dated Oct. 17, 2016, in connection with corresponding CN Application No. 201580002139.2 (13 pgs., including English translation).
Korean Office Action dated Oct. 26, 2016, in connection with corresponding KR Application No. 2016-7017398 (17 pgs., including English translation).
Extended European Search Report dated Feb. 28, 2017, including the Supplementary European Search Report and the European Search Opinion, in connection with corresponding EP Application No. 15758978.9 (7 pgs.).

* cited by examiner

SCENTED PAPER TISSUE CONTAINER

TECHNICAL FIELD

The present invention relates to a scented paper tissue container.

BACKGROUND ART

Paper tissue containers, in which a stack of paper tissues are contained in a rectangular-parallelepiped-shaped containing box which is also referred to as a carton, are well known. Some of such paper tissue containers are scented.

In existing scented paper tissue containers, paper tissues are scented by applying perfume-containing microcapsules, in which a perfume is enclosed, to the paper tissues.

However, this method has problems in that the yield of perfume-containing microcapsules when applied to the paper tissue is low and in that a large production-switching loss occurs when switching production from scented paper tissues to unscented paper tissues because, for example, it takes time to clean the equipment. Accordingly, this method has a problem in that the production cost is very high. This results in a high product price, which discourages widespread use.

In recent years, scented paper tissue containers have been marketed in which a slit film, which is a general component of a container box structure of a paper tissue container, includes a perfume, and the perfume volatilized from the slit film provides a scent to paper tissues in the containing box so that the scent lingers in the paper tissue. The scented paper tissues can be produced at a lower cost than paper tissues to which perfume-containing microcapsules are directly applied.

However, the slit film, from which the perfume is volatilized, is a laminate including a film material having low gas-barrier property and a perfume-containing adhesive. The perfume passes through the film material and gradually volatilizes, and a mild scent is released over a long time. Therefore, it is not possible to adjust the strength of scent when, for example, a user desires a strong scent. For example, a menthol-based scent, a mint-based scent, and a citrus-based scent produce a highly refreshing sensation and a highly cooling sensation by momentarily releasing a strong scent. With existing scented paper tissue containers, in which a scent is released from a slit film, it is difficult to give off a scent that produces such a strong refreshing sensation and a strong cooling sensation.

CITATION LIST

Patent Literature

PTL 1: Japanese Unexamined Patent Application Publication No. 2012-196382

PTL 2: Japanese Patent No. 5225591

SUMMARY

Accordingly, the main object of the present invention is to provide a scented paper tissue container that does not have the problems of containers in which a perfume is directly applied to paper tissues, such as the problem of production-switching loss due to switching of production between unscented paper tissues and scented paper tissues and a low yield in the perfume-containing microcapsules, and that is capable of strengthening a scent when necessary.

Solution to Problem

An exemplary embodiment of the present invention, which solves the aforementioned problems, is as follows.

A paper tissue container in which a stack of folded paper tissues are contained in a containing box that includes a rectangular-parallelepiped-shaped box body, a perforation line formed in the box body, and a slit film that is affixed so that a slit is located in a region surrounded by the perforation line, the box body having an upper surface, a bottom surface, and a pair of long side surface and short side surface connected to the upper surface and the bottom surface, wherein, independently from the slit film, a scented sheet member, in which a gelatin gel including at least one of a perfume and a perfume-containing microcapsule is enclosed in a space between film sheets in at least one of which a perfume-permeating hole is formed, is affixed to a region including at least an inner surface of the upper surface of the containing box so that the at least one of the film sheets having the perfume-permeating hole faces the stack of paper tissues.

The paper tissue container described above, wherein a diameter of the perfume-permeating hole is in the range of 10 to 100 μm.

The paper tissue container described above, wherein the gelatin gel solates at a temperature in the range of 30 to 40° C.

The paper tissue container above, wherein each of the film sheets is one of a polyethylene film, a polypropylene film, a polyethylene terephthalate film, a polystyrene film, and an ethylene-vinylalcohol copolymer film.

(Operational Effects)

To produce a stack of paper tissues that are folded and to which perfume is directly applied, it is necessary to apply a perfume to a whole sheet, which is the precursor of the paper tissues. Production equipment for producing paper tissues is very large equipment including a papermaking machine and a stacking machine for making multiple-ply paper tissues. Therefore, when applying a perfume to such a whole sheet, a large deodorizing machine is necessary or it takes time to clean the equipment, and thus a large production loss occurs when switching production between unscented paper tissues and scented paper tissues. Moreover, when applying perfume-containing microcapsules to paper tissues, it is necessary to disperse the microcapsules in a low-viscosity solution so as not to affect the softness or the texture of the paper tissues. During application, the microcapsules, which are expensive, tend to rupture and the yield is low. With the paper tissue container according to the present invention, a perfume is not directly applied to paper tissues, so that it is not necessary to switch production between unscented paper tissues and scented paper tissues. That is, a problem does not occur when applying a perfume to paper tissues.

A gelatin gel can be easily solated by heating the gelatin gel to about human body temperature and can be liquefied by heating further. Therefore, when a part of the scented sheet member according to the present invention is heated, the gelatin gel is solated. Due to solation of the gelatin gel, a perfume in the gelatin gel can be more easily released to the outside than when a perfume is dispersed in a half-solid gel, and a strong scent is released from the scented sheet member. According to exemplary embodiment of the present invention, the scented sheet member is disposed on the inner surface of the upper surface of the containing box, which a user can easily touch by inserting his/her finger through the paper tissue dispense opening. Therefore, a user can intentionally strengthen a scent by performing such an operation when the user wants to sense a strong scent.

As described above, the present invention provides a scented paper tissue container that does not have the problems of containers in which a perfume is directly applied to paper tissues, such as the problem of production-switching loss due to switching of production between unscented paper tissues and scented paper tissues and a low yield in the perfume-containing microcapsules, and that is capable of releasing a strong scent when necessary.

DESCRIPTION OF EMBODIMENTS

Figure 1:
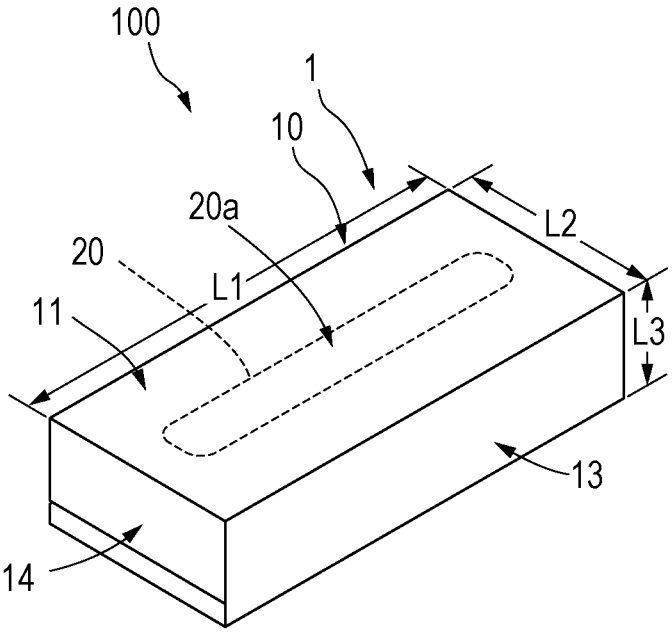
FIG. 1 is a perspective view of a paper tissue container according to an embodiment of the present invention.
Figure 2:
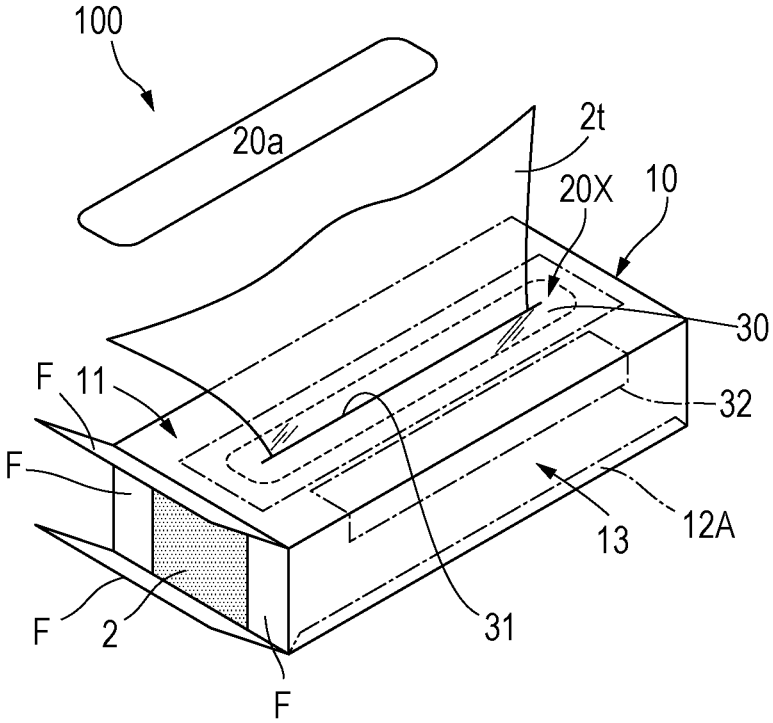
FIG. 2 is a perspective view illustrating the structure of the paper tissue container according to the embodiment of the present invention.

Next, an embodiment of the present invention will be described with reference to FIGS. 1 to 8. As illustrated in FIGS. 1 and 2, in a paper tissue according to the present embodiment, a paper tissue stack 2 of a plurality of paper tissues 2*t*, each of which is folded in a pop-up manner, are contained in a containing box 1 that has a perforation line 20 formed in a containing box upper surface 11. The paper tissue container 100 is used to take out the paper tissue 2*t* from a dispense opening 20X, which is formed by tearing the perforation line 20.

Regarding the paper tissue container 100 according to the present embodiment, the paper tissues 2*t* contained in the containing box 1 are not particularly limited and may be known paper tissues. The paper tissues may be moisturizing paper tissues, to which a softening agent or a moisturizing agent, such as polyol, is applied.

The containing box 1 illustrated in the figures, which has a rectangular-parallelepiped-shape, includes a box body 10, which has the perforation line 20 for forming the dispense opening 20X in the upper surface 11, and a slit film 30, which covers a region 20*a* surrounded by the perforation line 20 from the inner surface of the upper surface of the box body.

The box body 10, which is the outer shell of the containing box 1, may have a size, an external shape, a development shape, and the like that are the same as those of box bodies of known containing boxes. In general, a containing box have a size such that a long edge L1 is in the range of about 110 to 320 mm, a short edge L2 is in the range of about 70 to 200 mm, and a height L3 is in the range of about 40 to 150 mm. Preferably, the containing box 1 according to the present invention has this size. The inner surface and the outer surface of the box body may be printed as appropriate.

As the base material of the box body 10, known paper materials or paper-processed materials, which are mainly made of pulps, such as virgin pulp and recycled pulp, can be used. Preferably, the material of the box body 10 is a coated cardboard having a basis weight in the range of 250 to 500 $g/m^2$.

Figure 3:
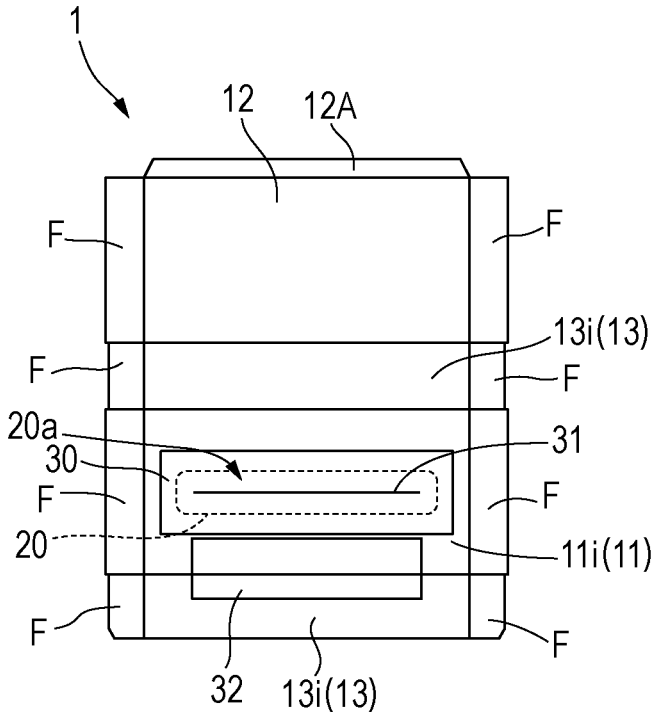
FIG. 3 is a development view of a containing box according to the embodiment of the present invention seen from the inside of the box.
Figure 4:
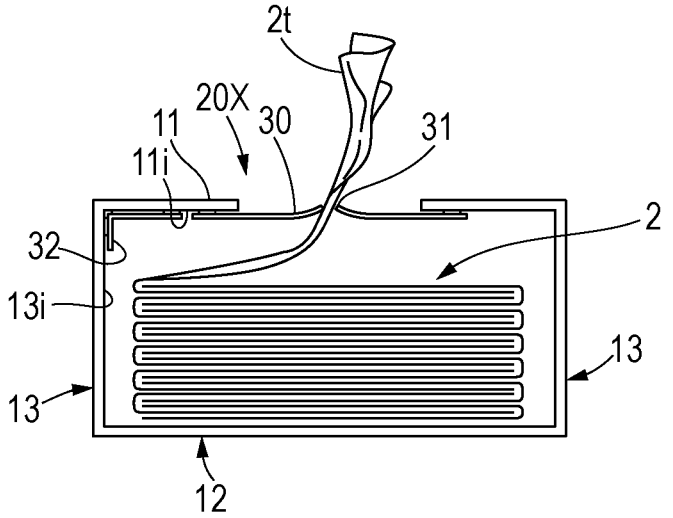
FIG. 4 is a cross-sectional view of the paper tissue container according to the embodiment of the present invention.
Figure 5:
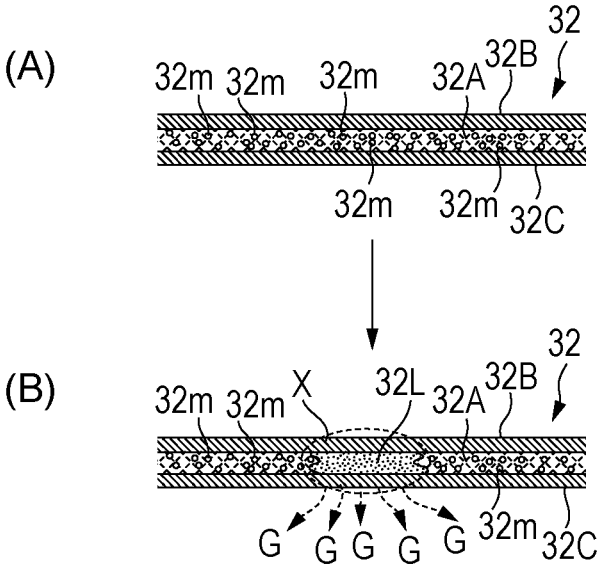
FIG. 5 illustrates cross-sectional views showing the mechanism by which a scented sheet member according to the embodiment of the present invention releases a scent.

As can be understood from FIGS. 2 and 3, the basic assembly structure of the box body 10 is as follows: after gluing a bottom surface 12 and one of long side surfaces 13 to each other at a gluing tab 12A; flaps F, which extend from the upper surface 11, the bottom surface 12, and the long side surfaces 13 connecting these surfaces 11 and 12, are bent toward the inside of the box body; and short side surfaces 14 are formed by bonding contact portions of the flaps F by using a hot-melt adhesive or the like. However, the box body 10 according to the present invention is not limited to this assembly structure.

The perforation line 20 formed in the upper surface 11 of the box body 10 has an annular shape, and the cut/tie ratio of the perforation line 20 may have any appropriate value. The perforation line 20 may be an ordinary perforation line, a double perforation line, a zipper perforation line, or the like. Only a part of the perforation line 20 may be a double perforation line.

The perforation line 20 according to the present embodiment has long sides extending in the longitudinal direction of the paper box and short sides that connect ends of the long sides to each other and parallel to the short edge. The shape of a region 20X that is surrounded by the perforation line 20 is an appropriate shape that is elongated in a direction parallel to the longitudinal direction of the containing box 1. In general, the shape of the region 20X is a rounded rectangle that is slightly elongated in the longitudinal direction of the containing box 1, or a substantially elliptical shape that is formed by making middle portions of long sides of the rectangle bulge outward in arch shapes. The shape illustrated in the figures is an example of the former.

Regarding a region surrounded by the perforation line according to the present embodiment, in the paper tissue container 100 according to the present embodiment, it is desirable that a user can touch an inner surface 11*i* of the upper surface of the containing box 1 with his/her finger as described below. Therefore, at least the region 20*a* surrounded by the perforation line 20 has an area that allows a user to insert his/her finger into the dispense opening 20X, which is formed when the perforation line 20 is torn.

The slit film 30 is larger than the region 20*a* surrounded by the perforation line 20 and is, for example, rectangular or elliptical. The slit film 30 is affixed, by using an adhesive, to a part of the inner surface 11*i* of the containing box upper surface outside the region 20*a* surrounded by the perforation line 20 so as not to, in particular, affect tearing of the perforation line 20. A slit 31 of the slit film 30 is located in the region 20*a* surrounded by the perforation line 20 so as to extend in the longitudinal direction. Accordingly, as illustrated in FIGS. 1 and 2, by cutting along the perforation line 20 and removing the region 20*a* surrounded by the perforation line 20, the dispense opening 20X is formed in the paper box upper surface 11, and the slit film 30 and the slit 31 are exposed through the dispense opening 20X. Then, the paper tissues 2*t* can be taken out through the slit 31 one by one. As described above, regarding the paper tissue container according to the present embodiment, it is desirable that a user can touch the inner surface 11*i* of the containing box upper surface with his/her finger. Therefore, the slit 31 has at least a length with which a slit opening 31*a* that allows a user to insert his/her finger can be formed.

The containing box 1 of the scented paper tissue container 100 according to the present invention is characterized in having a scented sheet member 32, which is independent from the slit film 30. As illustrated in FIG. 5(A), in the scented sheet member 32, a gelatin gel 32A, including at least one of a perfume (not shown) and perfume-containing microcapsules 32*m*, is enclosed in a space between film sheets 32B and 32C. In at least one of the film sheets 32B and 32C, a large number of very small perfume-permeating holes (not shown) are formed. The gelatin gel 32A is enclosed in the space so as to be gel-tight to a degree such that the gelatin gel 32A does not leak unless an appropriate physical stimulus is provided to the scented sheet member 32. In the paper tissue container 100 according to the present embodiment, the scented sheet member 32 is affixed to a region including at least the inner surface 11*i* of the upper surface of the containing box 1 so that the film sheet having the perfume-permeating holes faces the stack 2 of the paper tissues 2*t*. With such a structure, a perfume included in the gelatin gel 32A or a perfume leaked from the perfume-containing microcapsules, which have ruptured during production or due to a physical stimulus, becomes dispersed in the gelatin gel 32A. The perfume dispersed in the gelatin gel 32 volatilizes into the containing box through the material of the film sheets 32B and 32C itself or through the perfume-permeating holes formed in the film sheets 32B and 32C and releases a mild scent.

Figure 6:
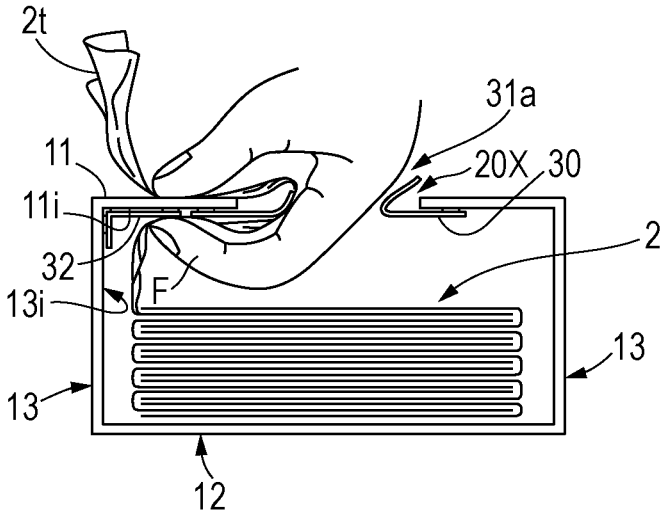
FIG. 6 is a cross-sectional view illustrating an example of how the scented paper tissue container according to the embodiment of the present invention is used.

The gelatin gel 32A can be easily solated by heating the gelatin gel 32A to about human body temperature. Accordingly, as illustrated in FIG. 5(B), when a part of the scented sheet member 32 according to the present embodiment is heated, a part of the gelatin gel 32A is solated, and thereby the fluidity of the gelatin gel increases. Therefore, the perfume more easily volatilizes from the film material or through the perfume-permeating holes or leaks through the perfume-permeating holes than when the perfume in the gelatin gel is dispersed in a half-solid gel. Accordingly, due to solation of the gelatin gel 32A, the perfume can be easily released to the outside of the scented sheet member, and a strong scent is released from the scented sheet member (in FIG. 5(B), the heated part is schematically shown by a symbol X, the solated part of the gelatin gel is schematically shown by a numeral 32L, and volatilized perfume is schematically shown by symbols G). Therefore, with the paper tissue container 100 according to the present embodiment, as illustrated in FIG. 6, a user can solate the gelatin gel 32A by inserting his/her hand into the containing box through the slit opening 31*a* and touching, pressing, or rubbing the scented sheet member 32 with his/her finger. Moreover, in doing so, the user can rupture the perfume-containing microcapsules 32*m* by providing a physical stimulus. As the gelatin gel 32A solates, a perfume can be more easily released to the outside of the scented sheet member than when the perfume is dispersed in a half-solid gel, and the perfume leaks from the perfume-containing microcapsules 32*m*. Therefore, a user can cause the scented sheet member 32 to release a strong scent by performing such an operation. That is, with the paper tissue container 100 according to the present embodiment, a user can intentionally make a strong scent to be selectively released.

In the case where the scented sheet member 32 includes the perfume-containing microcapsules 32*m* and a highly volatilizable perfume that releases a scent, such as menthol-based scent, mint-based scent, or citrus-based scent, is enclosed in the perfume-containing microcapsules 32*m*, the highly volatilizable perfume becomes instantaneously dispersed in the gelatin gel when the microcapsules rupture. Therefore, the scent is released instantaneously and strongly, so that a user can sense a strong refreshing sensation and a strong cooling sensation.

In order that the gelatin gel 32A can be solated easily, preferably, the gelatin gel 32A is appropriately selected from gels whose solation temperature is in the range of 30 to 40° C., and more preferably in the range of 34 to 38° C. Because the temperature of the palm of a human hand is approximately in the range of 34 to 38° C., the gelatin gel 32A can be solated at such a temperature.

Preferably, the diameter of the perfume-permeating holes formed in the film sheets 32B and 32C is in the range of 10 to 100 μm so that the gelatin gel and solated gelatin gel may not leak from the film sheets without a physical stimulus and a perfume can effectively volatilize or leak by the operation described above. More preferably, the diameter is in the range of 15 to 30 μm. The perfume-permeating holes can be formed by using a known technology for forming micropores in a film sheet. For example, a film sheet having micropores can be formed by filling a film sheet material with microparticle materials and drawing the film sheet material.

Figure 7:
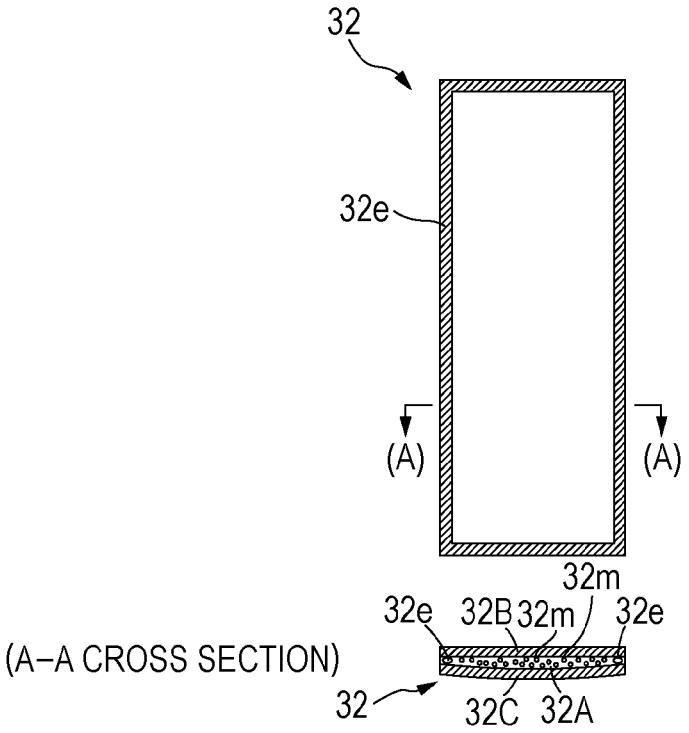
FIG. 7 illustrates a plan view and a cross-sectional view of a scented film according to the embodiment of the present invention.
Figure 8:
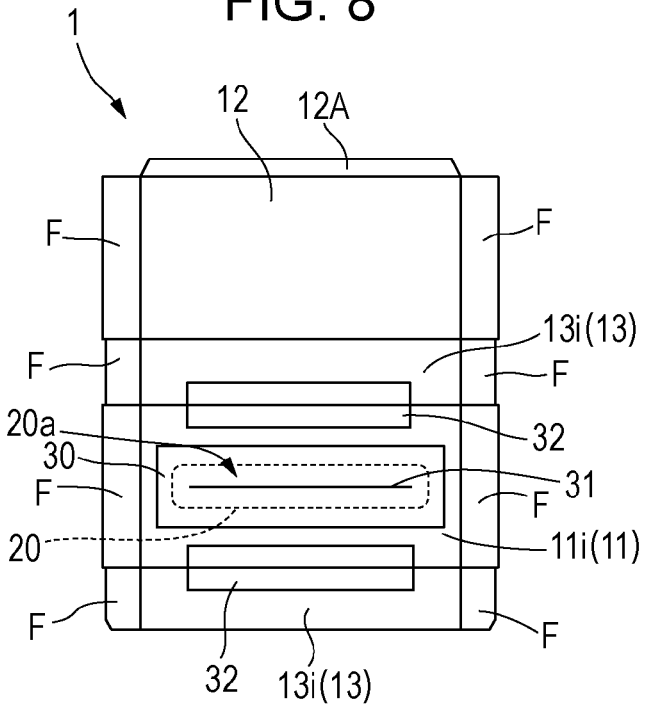
FIG. 8 is a development view of another containing box according to the embodiment of the present invention seen from the inside of the box.

To prevent unintentional leak of a perfume or the gelatin gel 32A including the perfume-containing microcapsules 32*m* from a space between the film sheets 32B and 32C, as illustrated in FIG. 7, the space can be liquid-tightly sealed by fusing peripheral edge portions of the film sheets 32B and 32C together (in the figure, the heat-sealed portions of the peripheral edges are denoted by a numeral 32*e*). However, in the present invention, the technology for liquid-tightly holding the gelatin gel 32A in a space between the film sheets 32B and 32C is not particularly limited. The peripheral edges of the film sheets 32B and 32C may be bonded to each other by, instead of fusing, supersonic welding or using an adhesive as long as a sufficient level of gel-tightness can be ensured.

As each of the film sheets 32B and 32C of the scented sheet member 32, a polyethylene film, a polypropylene film, a polyethylene terephthalate film, a polystyrene film, or an ethylene-vinyl alcohol copolymer film is suitable. In particular, when a polyethylene film or a polypropylene film is used, because such a film has low gas-barrier property, a perfume can easily pass through the film. Thus, a mild scent can be released without heating or providing a physical stimulus to the scented sheet member 32. Because the film sheets 32B and 32C are inexpensive and have good processibility, such as heat-sealability, the scented sheet member 32 having a liquid-tight structure illustrated in FIG. 7 can be easily formed.

In the present invention, a method of enclosing the gelatin gel 32A in a space between the film sheets 32B and 32C is not particularly limited. Examples of other methods include the following: a method in which, after applying the gelatin gel 32A including a perfume or perfume-containing microcapsules to the film sheet 32B (32C), the film sheet 32C (32B) is superposed on the film sheet 32B (32C) and predetermined positions are heat-sealed; and a method in which, after forming a flat bag having an opening from the film sheets, the gelatin gel 32A is injected into the bag and the opening is tightly sealed.

Preferably, the thickness of the scented sheet member 32 is in the range of 30 to 200 μm. When the thickness is in this range, the scented sheet member 32 can be easily affixed to the inside of the containing box. If the thickness is greater than 200 μm, when the gluing tab 12A is glued to make the containing box 1 into a tubular shape, the containing box 1 may become deformed due to the thickness of the scented sheet member 32 while the containing box 1 is transported. If the thickness is less than 30 μm, it is difficult to enclose a sufficient amount of the gelatin gel 32A in the scented sheet member 32. Moreover, the thickness of each of the film sheets 32B and 32C is preferably in the range of 5 to 80 μm. In this case, the scented sheet member 32 is not likely to be torn. Although the amount of the gelatin gel 32A enclosed is not particularly limited, to prevent the thickness of the scented sheet member 32 from becoming excessively large and to enable a sufficient scent to be released, the thickness is preferably in the range of 10 to 100 μm, and the amount of the perfume and the perfume-containing microcapsules is preferably in the range of 1 to 10 $g/m^2$.

The perfume-containing microcapsules 32*m*, included in the gelatin gel 32A, are microcapsules in which a perfume is enclosed. The outer shell of each of the microcapsules 32*m* is not limited. Examples include a melamine resin, a urethane resin, and a urea resin. In particular, a melamine resin is preferable, because it has an appropriate rupturability and perfume permeability. In the present invention, a method of forming microcapsules is not particularly limited. An appropriate method may be selected from chemical methods, such as an in-situ method and an interfacial polymerization method. The thickness of the film of the microcapsules, although not particularly limited, may be in the range of about 0.1 to 1.0 μm, and preferably in the range of 0.1 to 0.5 μm.

Preferably, the average particle diameter of the perfume-containing microcapsules 32*m* is in the range of 10 to 50 μm. When the average particle diameter is in this range, the perfume-to-capsule weight ratio can be increased and a sufficient amount of perfume can be included in a desired scented sheet member. However, as the capsule diameter increases, the capsules may be broken in the production process and the yield may decrease. Therefore, more preferably, the average particle diameter of the perfume-containing microcapsules 32*m* is in the range of 15 to 30 μm. The average particle diameter used here is the median diameter.

Any appropriate perfume can be used as the perfume. Examples of the perfume include natural perfumes, such as lemon oil, grapefruit oil, rosemary oil, peppermint oil, mandarin oil, lime oil, citrus junos oil, chamomile oil, lavender oil, rose oil, and spearmint oil; synthetic perfumes, including alcohol-based perfumes, such as linalool, citronellol, menthol, and geraniol; and chemical substances such as 2-methylbutyric acid ethyl ester, β-pinene, isoamyl acetate, 2-methylpentanoic acid ethyl ester, β-myrcene, ethyl hexanoate, 3-methyl-2-buten-1-ol acetate, 3-hexene-1-of acetate, tetrahydro-4-methyl-2-(-2-methylpropyl)2H-pyran, isocyclocitral, 2,4-dimethyl-7-octene-2-ol, 3,7-dimethyl-1,6-octadene-3-ol, 4-tert-butylcyclohexyl acetate, 2-(1,1-dimethylethyl)-cyclohexanol, 1-phenylethyl acetate, and 1,1-dimethyl-2-phenylethyl butanoate. One of these may be used, or a compound perfume including some of these may be used. The perfume may be selected in accordance with the desired type of scent.

As can be understood from the figures, in the paper tissue container 100 according to the present embodiment, the scented sheet member 32 is affixed to the inner surface 11*i* of the containing box upper surface 11 and to an inner surface 13*i* of the long side surfaces 13. By affixing the scented sheet member 32 to a region including at least the inner surface 11*i* of the containing box upper surface, as illustrated in FIG. 6, when a user inserts his/her finger through the slit opening 31*a*, the user can easily touch the scented sheet member 32. In particular, when the scented sheet member 32 is affixed to the inner surface 11*i* of the containing box upper surface, even in an initial state of use in which the upper surface of the paper tissue stack 2 is close to or in contact with the inner surface 11*i* of the containing box upper surface, a user can insert his/her finger and touch the scented sheet member 32. In the paper tissue container 100 according to the present embodiment, the stack 2 includes the paper tissues 2*t*, which are folded in a pop-up manner. In the pop-up stack, the paper tissues 2*t* are each folded in half and alternately stacked so that the edges of each folded paper tissue 2*t* are located on inner surfaces of paper tissues 2*t* that are directly above and below the paper tissue 2*t*. Therefore, as illustrated in FIG. 6, a user can insert his/her finger through the slit opening 31*a* so that the finger slides over a lower surface of a paper tissue that is exposed from the slit. In this case, the user can heat or provide a stimulus to the scented sheet member 32 with his/her finger without directly touching the scented sheet member 32 but via an uppermost paper tissue or a paper tissue directly below the uppermost one. By doing so, a perfume is not likely to adhere to the finger, and a strong scent can be provided to the paper tissue that is exposed from the slit and that is to be used immediately. The paper tissue stack 2 can be made by using a known interfolder of a multistand type or a rotary type.

Moreover, as in the example illustrated in the figures, by affixing the scented sheet member 32 to the inner surface 13*i* of one of the containing box long-side side surfaces, the perfume can be volatilized from the scented sheet member 32 at a position near the paper tissue 2*t* even when some paper tissues 2*t* have been pulled out and the height of the position of the upper surface of the paper tissue stack 2 has decreased.

As an adhesive for bonding the scented sheet member 32 to the box body 10, a known adhesive that is similar to the adhesive for bonding the slit film 30 can be used. Examples of usable adhesives include natural rubber-based, natural-rubber-latex-based, acrylic-based, hot-melt based, and polyester-based tackiness agents or adhesives.

In the example shown in FIGS. 2 to 4 and 6, one scented sheet member is affixed to the inside of the containing box. However, the number of scented sheet members 32 in the present invention is not limited to one. As in the example illustrated in FIG. 8, two scented sheet members may be affixed.

In the paper tissue container 100 according to the present embodiment, the slit film 30 and the scented sheet member 32 are independent from each other. In existing paper tissue containers, in which the slit film 30 releases a scent, the film tends to become stiff because a perfume layer is provided to the film by using an adhesive or the like, and therefore a paper tissue may not be easily pulled out through the slit. In contrast, the present invention also has an advantage in that the original function of the slit film, which is to allow a paper tissue to be smoothly pulled out, is not reduced.

REFERENCE SIGNS LIST

100 paper tissue container
2 paper tissue stack

2*t* paper tissue
11 containing box (paper box) upper surface
20 perforation line
1 containing box
20*a* region surrounded by perforation line
20X dispense opening
30 slit film
10 box body
L1 long edge of containing box
L2 short edge of containing box
L3 height of containing box
12 containing box (paper box) bottom surface
12A gluing tab
13 containing box (paper box) long side surface
14 containing box (paper box) short side surface
F flap
11*i* inner surface of containing box (paper box) upper surface
31 slit
31*a* slit opening
32A gelatin gel
13*i* inner surface of containing box (paper box) long side surface
32 scented sheet member
32*m* perfume-containing microcapsules
32B, 32C film sheet
32*e* heat-sealed portion
X heated part

The invention claimed is:

1. A paper tissue container in which a stack of folded paper tissues are contained, comprising:

a containing box with a rectangular-parallelepiped-shaped box body, a perforation line formed in the box body, and a slit film that is affixed to the containing box so that a slit is located in a region surrounded by the perforation line, the box body having an upper surface, a bottom surface, and a pair of long side surfaces and a pair of short side surfaces connected to the upper and bottom surfaces, respectively, a scented sheet member independent from the slit film, in which a gelatin gel including at least one of a perfume and a perfume-containing microcapsule including a perfume is enclosed in a space between film sheets in at least one of which a perfume-permeating hole is formed, the perfume or perfume-containing microcapsule including perfume being volatilized through the perfume-permeating hole and volatilization of the perfume or perfume-containing microcapsule including perfume from the perfume-permeating hole is increased due to solation of the gelatin gel, wherein the solation of the gelatin gel is configured to be triggered by the gelatin gel being brought to a temperature of at least 30° C. by a heat source, wherein the scented sheet member is affixed to a region including at least an inner surface of the upper surface of the containing box so that the at least one of the film sheets having the perfume-permeating hole faces the stack of paper tissues.

2. The paper tissue container according to claim 1, wherein a diameter of the perfume-permeating hole is in the range of 10 to 100 μm.

3. The paper tissue container according to claim 1, wherein the gelatin gel solates at a temperature in the range of 30 to 40° C.

4. The paper tissue container according to claim 1, wherein each of the film sheets is one of a polyethylene film, a polypropylene film, a polyethylene terephthalate film, a polystyrene film, and an ethylene-vinylalcohol copolymer film.

* * * * *